United States Patent [19]

Buck

[11] 4,245,879

[45] Jan. 20, 1981

[54] LATCH ASSEMBLY

[75] Inventor: Josef J. Buck, Minneapolis, Minn.

[73] Assignee: Magnetic Controls Company, Minneapolis, Minn.

[21] Appl. No.: 914,529

[22] Filed: Jun. 12, 1978

[51] Int. Cl.[3] ..... H01R 13/62

[52] U.S. Cl. ..... 339/91 R; 339/128

[58] Field of Search ..... 339/91 R, 91 B, 91 F, 339/91 L, 91 P, 74 R, 75 R, 75 M, 128

[56] References Cited

U.S. PATENT DOCUMENTS

| | | | |
|---|---|---|---|
| 3,639,950 | 2/1972 | Lutz | 339/74 R X |
| 3,722,927 | 3/1973 | Miska | 339/91 R X |
| 3,867,000 | 2/1975 | Michalak | 339/91 R X |
| 4,008,940 | 2/1977 | Foley | 339/91R |

*Primary Examiner*—Howard N. Goldberg
*Assistant Examiner*—John S. Brown
*Attorney, Agent, or Firm*—Dorsey, Windhorst, Hannaford, Whitney & Halladay

[57] ABSTRACT

An improved latch assembly adapted particularly for use in the electronics or communications industry to retain a plug member in electrical engagement with a receptacle and prevent relative movement therebetween in a latching direction. The latch assembly includes a first latch member adapted for limited movement in a direction generally parallel to the latching direction between first and second positions and for limited movement in a direction generally perpendicular to the latching direction between engaged and disengaged positions. The latch assembly further includes a spring member for biasing the first latch member toward an engaged position, a stop member for limiting the movement of the first latch member in a direction opposite the latching direction and a guide member for causing movement of and guiding the first latch member toward its second position during movement of the latch member toward its disengaged position.

16 Claims, 10 Drawing Figures

LATCH ASSEMBLY

BACKGROUND OF THE INVENTION

The present invention relates generally to an improved latch assembly, and more particularly, to an improved latch assembly for a monitor or patch cord plug or the like usable in the electronics or communications industry.

The prior art includes a great many different types and forms of latches for securing or retaining one member or element in a relatively fixed position with respect to another. In particular, various types of latch mechanisms and assemblies exist in the electronics and communications industry. These latch mechanisms may, among other things, be used to secure or retain a plug member in fixed relationship with a receptacle to insure electrical connection between the plug and receptacle and to avoid accidental or inadvertant disengagement of the members. A specific example of a latching assembly or mechanism in the communications industry involves the incorporation of such an assembly or mechanism in a monitor or patch cord plug to retain the same in a circuit monitoring module. More particularly, such latch mechanism includes a unitary piece of spring metal securely seated and retained within the plug member. This spring member includes a shoulder portion which, upon insertion of the plug into the receptacle or module, engages a corresponding shoulder portion, and a curved portion joining the shoulder portion with the portion secured to the plug and imparting an engaging force to the shoulder. The shoulder of the spring member is designed so that it can be manually depressed when removal of the plug is desired. When not depressed, this shoulder portion serves to retain the plug member within the receptacle to ensure electrical contact therebetween.

One problem which exists in the art with respect to most latch members arises when someone attempts to disengage the members that are latched together without first properly releasing the latch mechanism. This is particularly true with respect to latches in the electronics and communications industry since users often attempt to disengage the plug member from the receptacle by pulling on the cord connected to the plug or by pulling on the plug member itself without depressing or otherwise releasing the latch assembly. As a result, significant stress is placed on the latch assembly, and particularly the latch spring, to the point where it "cams-out" or prematurely releases, eventually resulting in its inability to properly serve as a latching mechanism.

Accordingly, there is a real need in the latch assembly field and particularly, in the latch assembly field as applied to the electronics and communications industry for a latch assembly capable of withstanding the forces caused by attempts to remove the plug without properly releasing the latch mechanism and ensuring that even if the latch releases under these conditions, the mechanism does not lose its latching ability.

SUMMARY OF THE INVENTION

The present invention relates generally to an improved latch assembly, and more particularly, to an improved latch assembly usable in retaining a plug member in association with a receptacle. In contrast to the prior art, this improved latch prevents premature disengagement of the members under normal forces, unless the latch is first released, and ensures that the latch assembly will retain its ability to serve its latching function despite repeated attempts to remove the plug without properly releasing the latch mechanism. More specifically, the latch assembly of the present invention functions to prevent movement in a latching direction of a first element or plug relative to a second element or receptacle and includes a latch member associated with the plug element. The latch member is adapted for limited movement generally parallel to the latching direction of the assembly between first and second positions and for limited movement to a direction generally perpendicular to the latching direction between an engaged position and a disengaged position. This latch member includes a shoulder portion for latching engagement with a corresponding shoulder portion of the receptacle. A latch spring or bias means is associated with the latch member to impart the necessary latching force thereto. The latch assembly of the present invention also includes a stop member for limiting movement of the latch member in a direction opposite the latching force. This stop member functions to relieve forces on the latch spring resulting from attempted disengagement without properly releasing the latch. This significantly prolongs the life of the latch assembly and increases the force necessary to disengage the assembly when the latch is not properly released. The latch assembly of the present invention also includes a guide means for causing movement of and guiding the latch member in the latching direction during movement of the latch member toward its disengaged position. This guide means functions to further increase the force necessary to disengage the plug and receptacle elements, without first releasing the latch.

Accordingly, it is an object of the present invention to provide an improved latch assembly for preventing movement in a latching direction of a first element relative to a second.

Another object of the present invention is to provide an improved latch assembly usable in the electronics and communications industry to retain a plug member in association with a receptacle.

Another object of the present invention is to provide an improved latch assembly capable of avoiding accidental or inadvertent disengagement of the latched members without properly releasing the same.

A further object of the present invention is to provide an improved means for relieving the forces exerted on the latch spring when the latched elements are attempted to be disengaged without properly releasing the latch assembly.

Another object of the present invention is to provide a latch assembly having an increased locking force.

These and other objects of the present invention will become apparent with reference to the drawings, the description of the preferred embodiment and the appended claims.

DESCRIPTION OF THE PREFERRED EMBODIMENT

Figure 5:
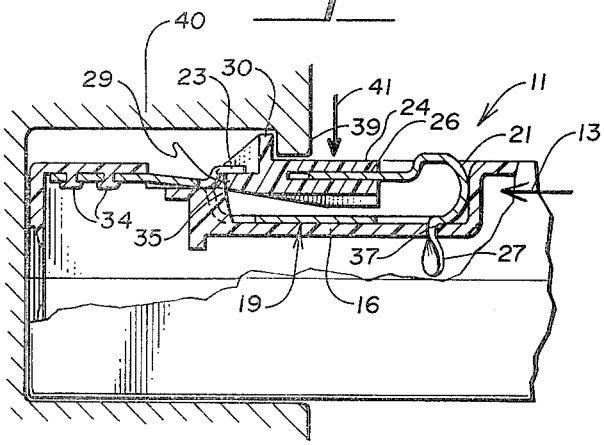
FIG. 5 is a side view, partially in section, of the plug and latch assembly of the present invention shown in its engaged position in a receptacle.

Although it is contemplated that the latch assembly of the present invention can have many different applications, the preferred embodiment shows its use in the electronics or communications industry to retain a plug within a receptacle and to prevent accidental or inadvertent disengagement without first properly releasing the latch. The general operation of the latch assembly can be understood best by reference to FIG. 5. As illustrated, a first element or plug member 11, which in the preferred embodiment is a monitor or patch cord plug, is adapted for insertion into a corresponding second element or receptacle 40. When fully inserted, electrical engagement occurs between corresponding contact elements in the respective elements 12 and 40. The plug 11 is retained within the receptacle 40 by the latch assembly which is comprised generally of the latch member 24 and the latch spring 19. The latch member 24 includes a shoulder portion adapted for corresponding engagement with a shoulder portion of the receptacle to provide latching engagement between the plug 11 and receptacle 40 in a latching direction. As shown in FIG. 5, the latching direction of the preferred structure is indicated by the directional arrow 13. When disengagement of the latch assembly and removal of the plug is desired, the latch member 24 is manually depressed at the point 41 and the plug 24 withdrawn.

Figure 1:
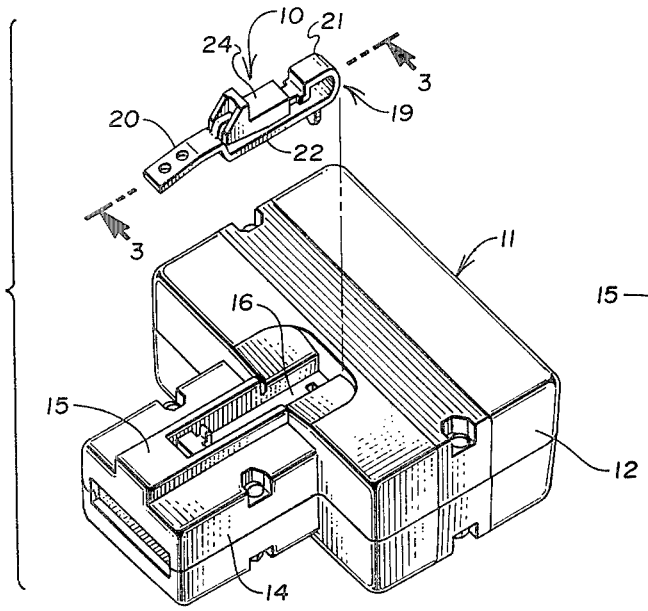
FIG. 1 is a pictorial, exploded view of a plug member and the improved latch assembly of the present invention associated therewith.
Figure 4:
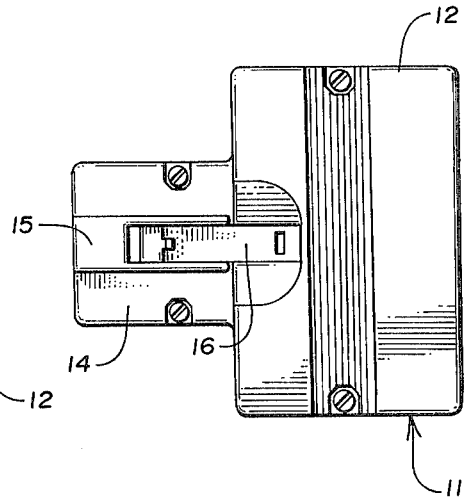
FIG. 4 is a plan view of a monitor plug of the type with which the latch assembly of the present invention is intended to be used.

The structural details of the present invention can be best understood by first referring to FIG. 1 showing a pictorial, exploded view of the plug and latch assembly. As illustrated, the monitor plug 11 includes a generally rectangular portion 12 housing the circuitry and various other operative elements of the plug and a forward section 14 extending from one end of the rectangular portion 12. This forward section 14 is intended for insertion into the receptacle and generally includes the contact elements for electrically engaging corresponding contact elements in the receptacle. The forward portion 14 further includes a guide rib 15 for ensuring proper orientation of the plug 11 in the receptacle. The plug 11 also includes an elongated latch assembly seat 16 into which the latch assembly 10 is disposed. The seat 16 is elongated in the general direction of the longitudinal axis of the plug member 11 and the latching direction and extends over portions of the rectangular and forward portions 12 and 14 of the plug.

The latch assembly 10 includes a bias means or latch spring member 19 having a forward end 20, a rearward curved portion 21 and an intermediate portion 22. The function of the bias or spring member is to bias or urge the latch member 24 toward its engaged position. The latch member 24 is connected with an end of the spring member adjacent the curved portion 21 and is movable relative to the spring 19 in a direction generally parallel to the longitudinal dimension of the spring 19 and generally parallel to the latching direction of the latch assembly. As shown, the latch spring 19 is configured for positioning within the seat portion 16 of the monitor plug 11.

Figure 2:
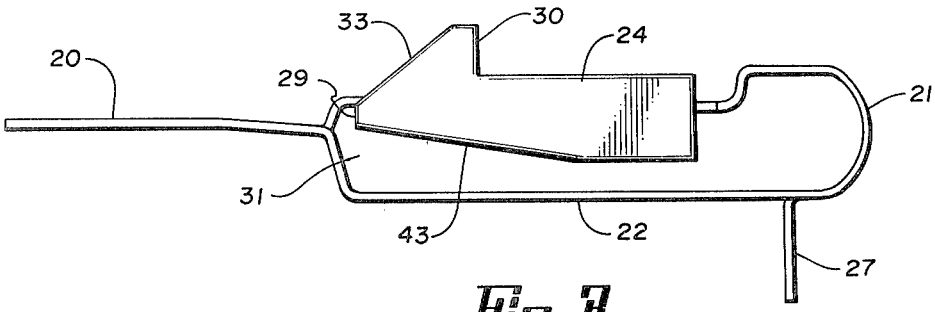
FIG. 2 is a side elevational view of the improved latch assembly of the present invention.

As illustrated more specifically in FIG. 2, the bias or spring member of the preferred embodiment is an elongated leaf spring member. The forward end 20 of such spring member comprises an elongated, relatively flat piece of spring metal having a pair of holes 25 therein for engagement with a corresponding pair of posts integrally formed with the plug 11. The rearward portion of the forward end 20 is integrally joined with the elongated intermediate portion 22 of the latch spring and lies within the seat portion 16 (FIG. 1). The intermediate section 22 extends rearwardly to where it is joined with the curved portion 21. The curved portion 21 is curved about a radius through approximately 180° to a point where it curves back toward the forward end of the latch spring 19. The curved portion is integrally connected through a stepped portion with an end section 26 which extends into and slidably supports the latch member 24. As illustrated best in the sectional view of FIG. 3, the elongated end portion 26 of the latch spring extends into a corresponding elongated slot or opening 28 in the latch member 24 for guiding and supporting the same. The slot or opening 28 is slightly larger than the exterior dimensions of the portion 26 to permit relative sliding movement between the latch member 24 and the latch spring portion 26 in a direction generally parallel with the longitudinal axis of the spring 19 and generally parallel to the latching direction 13 (FIG. 5). The sliding movement of the latch member 24 occurs between a first or forward position and a second or rearward position. The end section 26 includes a shoulder portion 17 rearwardly spaced from the end of the portion 26 and adapted for engagement with an interior shoulder of the member 24 to limit the rearward sliding movement of the latch member 24 along the section 26 and to define the second or rearward position of the latch member.

The spring member 19 also includes a finger or tab portion 23 integrally formed with the forward end of the spring and extending outwardly therefrom over a portion of the latch member 24. As will be discussed more fully below, the tab or finger 23 prevents the latch member 24 from sliding off the end portion 26 of the latch spring and allows for the bias means or curved portion of the spring 21 to be preloaded. A second tab member 27 extends from the lower surface of the elongated intermediate section 22 for securing the latch spring into engagement with the seat 16.

It is contemplated that the latch spring 19 can be constructed of various types of spring metal, plastic or other materials which are sufficient to impart the necessary latching force to the latch member 24. In the preferred embodiment, the spring member 19 is constructed of a copper alloy which exhibits the necessary spring characteristics and which has been found to have excellent resistence to corrosion without the need for any protective coating such as plated nickel or cadmium.

Figure 3:
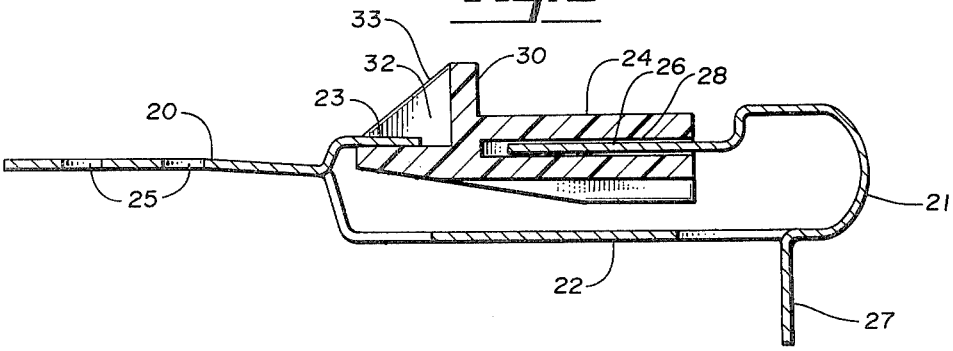
FIG. 3 is a sectional view of the improved latch assembly of the present invention as viewed along the line 3—3 of FIG. 1.

The details of the latch member 24 can best be seen in FIGS. 1, 2 and 3. As illustrated, the latch member 24 includes a forward nose portion 29, a shoulder or latching portion 30 and a rearward body portion which includes an opening or slot 28 (FIG. 3) for insertion of end member 26. In the preferred embodiment, the latch member 24 is adapted for generally arcuate or pivotal movement about a pivot point located in the curved portion 21 of the latch spring between an engaged position (FIG. 6) and a disengaged position (FIG 7). The resulting movement of the nose portion 29 is along the general path of the directional arrow 31. The nose portion 29 includes a flat forward portion adapted for engagement with a stop member 36 (FIGS. 6 and 8) to limit movement of the latch member 24 toward its forward or first position and a beveled surface 33. The surface 33 slides against a portion of the receptacle during insertion of the plug to depress the latch member 24 and allow it to engage a second latch member or shoulder 39 of the receptacle.

Figure 9:
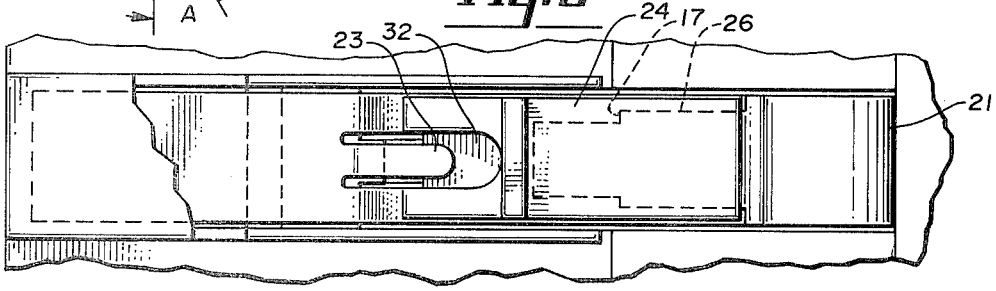
FIG. 9 is a plan view of the latch assembly of the present invention with the latch member in its rearward or second position.
Figure 10:
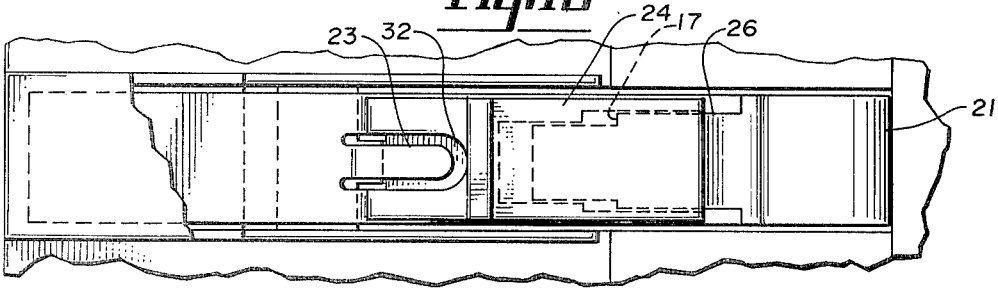
FIG. 10 is a plan view of the latch assembly of the present invention with the latch member in its forward or first position.

As illustrated best in FIGS. 1, 9 and 10, the forward portion 29 of the latch member 24 also includes a recessed portion 32 adapted for engagement by the elongated finger or tab portion 23. The finger or tab portion 23 extends outwardly from the main body portion of the latch spring 19 and over a portion of the recessed area 32 of the latch member. The finger or tab portion 23 serves two functions. First, it limits the possible forward movement of the latch member 24 so that it does not slide off the end portion 26 of the latch spring. Secondly, it limits the upward movement or movement toward an engaged position of the latch member 24 so that such member can be properly inserted into the receptacle and function in the manner intended. In this respect, it should be noted that the latch spring 19 is prestressed or preloaded so that the end 26 and thus the latch member 24 has a tendency to move upwardly to a higher rest position if the finger portion 23 were not present. Accordingly, this preloaded condition of the latch spring 19 in combination with the finger portion 23 insures that the latch member 24 is always in its upper or engaged position except when depressed for insertion or removal.

The latch member 24 also includes a lower surface 43 which is beveled so that when the latch member 24 is depressed, as illustrated in FIG. 7, the surface 43 engages the upper surface of the spring 19. The surface 43 extends rearwardly, at least to the point where the depression force 41 is exerted on the latch member 24. Accordingly, this surface 43 engaging the spring 19 supports the point of deflection pressure 41 during normal operation to prevent permanent deformation of the spring 19 as a result of overstressing the spring.

Reference is next made to FIGS. 5–10 which show the structural relationship between the latch assembly (the latch member 24 and the latch spring 19), the plug member 11 and the receptacle 40. As shown best in FIG. 5, the latch assembly seat 16 is an elongated section which is configured to seat the latch spring 19. The seat portion 16 includes an elongated opening 37 through which the tab portion 27 extends to retain the latch spring within the seat 16. After insertion the tab portion 27 is twisted approximately 90° to tighten the spring to the seat and to retain the same within the plug housing. The inside of the plug housing also includes a pair of posts 34 which extend through the openings 25 in the forward end 20 of the latch member to further secure the latch spring 19 to the plug housing. After insertion, the posts 34 are appropriately heat staked to permanently retain the latch spring therein.

Figure 7:
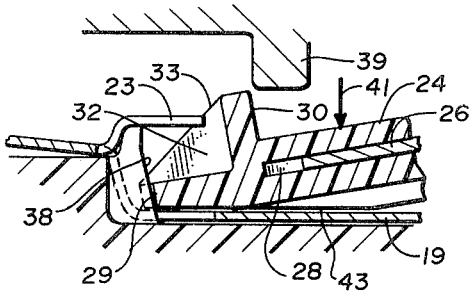
FIG. 7 is a side view similar to FIG. 6 with the latch member in its disengaged position.
Figure 8:
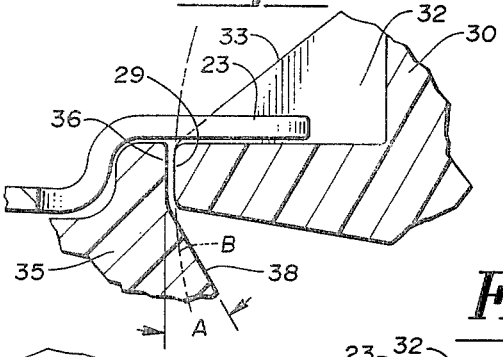
FIG. 8 is a close-up side view, partially in section, showing the relationship between the angle of the guide surface and the swing arc of the latch member.

A combination stop member and guide or locking member 35 is integrally formed with a portion of the plug housing. As illustrated, the member 35 extends through a cutout portion of the latch spring 19 with a portion of the spring positioned on each side of the member 35. In the preferred embodiment, this cutout portion forms the finger or tab portion 23. The upper portion of the member 35 is a stop member 36 adapted for engagement by the forward nose portion 29 of the latch member 24 for limiting the movement of the latch member 24 in a forward direction or direction opposite the latching direction. The stop member 36 also defines the first or forward position of the latch member 24. The lower portion of the member 35 includes a guide means for causing movement of and guiding the latch member rearwardly or toward its second position during downward movement of the latch member 24 toward its disengaged position. In the preferred embodiment, the guide means comprises a beveled portion 38 which is beveled downwardly as illustrated in FIGS. 5–8. The magnitude of the angle "A" (FIG. 8) at which the surface 38 is beveled is determined in the preferred structure by the swing radius or swing arc of the latch member 24 when in its first or forward most position against the stop member 36. As previously described, the latch member 24 is adapted for slight arcuate or pivotal movement about a pivot located in the general area of the curved portion 21 of the latch spring. When the latch member 24 is disposed in its forward most position against the stop member 36, pivotal movement of the latch member scribes an arc "B" as shown in FIG. 8. The inventor has found that to achieve all of the advantages of the present invention, the angle "A", defined with respect to a line extending through the nose portion 29 of the latch member and lying perpendicular to the latching direction, should be greater than the swing arc "B" resulting from the projected pivoting of the latch member 24 when in its forward most position. Due to this relationship between the angle "A" and the swing arc "B", downward movement or depression of the latch member 24 will result in slight rearward movement of the same due to the engagement between the nose portion 29 and the beveled surface 38. If the angle "A" were less than the swing arc "B", downward movement of the latch member 24 would result in no interference between the nose portion 29 and the beveled surface 38. On the other hand, the angle must not be so large that it increases the necessary releasing force to an undesirable level. For example, when manually depressing the latch member 24 to release the same, the nose portion must ride against the beveled surface. As the angle "A" increases, so does the releasing force. The inventor has found an angle of between about 5° and 10° and preferably about 8° to be desirable. It is contemplated that various other structures could be utilized to obtain the benefits of the present invention. In these other structures, however, the guide means should be such that rearward movement of the latch member 24 in the latching direction relative to the plug should occur upon movement of the latch member toward its disengaged position.

Figure 6:
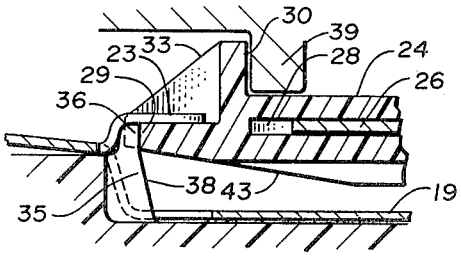
FIG. 6 is a side view, partially in section, of a close-up view of the latch member and its relationship to the stop member and guide means with the latch member in its engaged position.

As shown in FIGS. 5 and 6, the latching shoulder 30 of the latch member 24 is adapted for latching engagement with a second latch member or corresponding shoulder portion 39 of the receptacle 40. As can be seen, the latch member 24 must be depressed or moved downwardly before the plug can be disengaged from the receptacle. When inserted, the beveled surface 33 contacts a portion of the receptacle and causes depression of the latch member for insertion into the receptacle.

FIGS. 9 and 10 are plan views of the latch assembly of the present invention as installed in the plug member 11 with the latch member 24 shown in its second or rearward most position (FIG. 9) and its first or forward most position (FIG. 10).

Having described the structure of the present invention, the function and operation can be understood as follows. As illustrated best in FIGS. 5, 6 and 7, the monitor plug 11 is adapted for insertion into an appropriate receptacle 40. Upon insertion, the beveled surface 33 of the forward nose portion 29 engages an edge of the shoulder member 39 resulting in rearward and downward movement of the latch member 24. As the plug is further inserted into the receptacle, the latch member 24 is depressed until the shoulder 39 can be cleared, allowing the plug to be fully inserted into the receptacle. It should be noted that during insertion of the plug 11, there is no engagement or interference between the nose portion 29 and the beveled surface 38 since the stop member 24 is in its second or rearward most position. When the plug is fully inserted, the latch member 24 moves upwardly to its engaged position in which the shoulder portions 30 and 39 are engaged to prevent relative movement of the plug and receptacle in a latching direction. This upward movement results from the force supplied by the latch spring 19. This locks the plug member 11 within the receptacle. Normally, forces acting upon the plug member 11 from the spring contact members within the receptacle will tend to urge the plug member 11 toward the right as viewed in FIGS. 5–7 or in a direction out of engagement with the receptacle. This slight bias causes the latch member 24 to engage the shoulder 39 and move to its first or forward most position relative to the plug as illustrated in FIG. 10. In this position, the nose portion 29 of the latch member is in close proximity with the stop member 36.

It can be noted that any external forces acting on the plug 11 in the latching direction 13 (FIG. 5) will cause engagement between the nose portion 29 and the stop member 36. For example if, as often happens in the electronics and communications industry with respect to plugs, the plug is attempted to be removed by pulling on the cord or pulling on the plug member 11 itself without disengaging the latch mechanism, the shoulder portions 30 and 39 will engage and the movement of the latch member 24 relative to the plug will be limited by the stop member 36. This has the effect of releasing the stresses and forces acting upon the radius portion of the latch spring 21. Further, even despite fairly significant forces tending to pull the plug from the receptacle, the latch member 24 will not disengage due to the beveled surface 38. As shown in FIG. 6, the beveled surface 38 is at an angle greater than the swing arc of the nose portion 29. Therefore, in order for the nose portion 29 to move downwardly so as to release the shoulder portions 30 and 39, it must move against the beveled surface 38 and cause the entire latch member 24 to move rearwardly against the force tending to pull the plug from the receptacle. Accordingly, the beveled surface 38 acts as a locking angle to substantially increase the force necessary to pull the plug from the receptacle when the latch mechanism is not properly disengaged. In the preferred embodiment, the angle "A" is approximately 8°. It has been found that this angle requires a disengaging force of between 20 and 40 pounds before the latch member 24 will "cam-out" and release. When the latch mechanism is desired to be released, the latch member 24 is manually depressed at the point 41 (FIG. 5). This causes the latch member 24 to move downwardly to the point where the shoulder portion 30 can clear the shoulder 39. During this manual depression, the nose portion of the latch member 24 rides against the beveled surface 38.

Although the description of the preferred embodiment has been quite specific, it is contemplated that various modifications could be made to the invention without deviating from the spirit thereof. Accordingly, it is intended that the scope of the present invention be dictated by the appended claims, rather than by the description of the preferred embodiment.

I claim:

1. A latch assembly for providing latching engagement between a first element and a second element in a latching direction comprising:

a first latch member connected with said first element and adapted for latching engagement with a second latch member of said second element, said first latch member adapted for limited movement relative to said first element in a direction generally parallel to the latching direction between first and second positions and for limited movement in a direction generally perpendicular to the latching direction between an engaged position in which said first and second latch members are engaged and a disengaged position in which said first and second latch members are disengaged;

means for manually disengaging said first and second latch members;

bias means including a leaf spring for biasing said first latch member toward its engaged position said leaf spring being securely mounted to said first element and includes an elongated portion lying in an engaging a seat portion of said first element, an end upon which said first latch member is mounted for limited sliding movement, a curved portion connecting said elongated portion and said end and a tab member extending over a portion of said first latch member for retaining said first latch member in sliding relationship with respect to said end and for limiting the movement of said first latch member in a direction toward its engaged position;

a stop member connected with said first element for engagement by said first latch member for limiting the movement thereof in a latching direction and defining the first position of said first latch member; and guide means for causing movement of and guiding said first latch member toward said second position during movement of said first latch member toward its disengaged position.

2. The latch assembly of claim 1 wherein said first and second elements comprise an electrical plug and receptacle, respectively.

3. The latch assembly of claim 1 wherein said curved portion extends through approximately 180° so that said first latch member is supported along a line generally parallel to said elongated portion and wherein said curved portion is pre-stressed to bias said first latch member against said tab member.

4. The latch assembly of claim 3 wherein said first latch member includes a shoulder portion for latching engagement with said second element, a centrally disposed slot for insertion of said end of said leaf spring and a nose portion for engagement with said stop member and said guide means.

5. The latch assembly of claim 4 wherein said leaf spring includes a shoulder portion near said one end for limiting movement of said first latch member relative thereto and defining the second position of said first latch member.

6. A latch assembly for providing latching engagement between a first element and a second element in a latching direction comprising:

a first latch member connected with said first element and adapted for latching engagement with a second latch member of said second element, said first latch member adapted for limited movement relative to said first element in a direction generally parallel to the latching direction between first and second positions and for limited movement in a direction generally perpendicular to the latching direction between an engaged position in which said first and second latch members are engaged and a disengaged position in which said first and second latch members are disengaged;

bias means for biasing said first latch member toward its engaged position;

a stop member connected with said first element for engagement by said first latch member for limiting the movement thereof in a latching direction and defining the first position of said first latch member; and guide means including a beveled surface adapted for engagement by a portion of said first latch member for guiding and causing movement of said first latch member toward said second position during movement of said first latch member toward its disengaged position.

7. The latch assembly of claim 6 having means for manually disengaging said first and second latch members.

8. The latch assembly of claim 7 wherein said bias means includes a leaf spring.

9. The latch assembly of claim 6 wherein said stop member and guide means are integrally formed with each other and both are integrally formed with said first element.

10. The latch assembly of claim 9 wherein the movement of said first latch member between its engaged and disengaged positions is a generally arcuate movement about a center located in said curved portion and wherein said beveled surface is disposed at an angle relative to a line extending through said nose portion and lying perpendicular to the latching direction sufficient to cause movement of said first latch member toward its second position during movement of said first latch member toward its disengaged position.

11. The latch assembly of claim 10 wherein said first and second members comprise an electrical plug and receptacle, respectively.

12. The latch assembly of claim 11 when said first latch member includes a surface portion adapted for engagement with a portion of the elongated portion of said spring to limit the movement of said latch member toward a disengaged position.

13. The latch assembly of claim 12 wherein said beveled surface is disposed at an angle of between about 5° and 10° relative to the line extending through said nose portion and lying perpendicular to the latching direction.

14. The latch assembly of claim 13 wherein the movement of said first latch member between its engaged and disengaged is a generally arcuate movement about a center located in said curved portion and wherein said beveled surface is disposed at an angle relative to a line extending through said nose portion and lying perpendicular to the latching direction sufficient to cause movement of said first latch member toward its second position during movement of said first latch member toward its disengaged position.

15. A latch assembly for preventing movement in a latching direction of a first element relative to a second element comprising:

a first latch member having a shoulder portion for latching engagement with a second latch member of said second element and a nose portion, said first latch member adapted for limited movement relative to said first element in a direction generally parallel to the latching direction between first and second positions and for limited movement in a direction generally perpendicular to the latching direction between an engaged position in which said first and second latch members are engaged and a disengaged position in which said first and second latch members are disengaged;

bias means including a leaf spring for biasing said first latch member toward its engaged position, said leaf spring being securely mounted to said first element and including an elongated portion lying in and engaging a seat portion of said first element, an end for insertion into a centrally disposed slot in said first latch member for mounting the same for limited sliding movement with respect to said leaf spring end, a curved portion, connecting said elongated portion and said leaf spring end and extending through approximately 180° so that said first latch member is supported along a line generally parallel to said elongated portion, a tab member extending over a portion of said first latch member for retaining said first latch member in sliding relationship with respect to said leaf spring end and for limiting the movement of said first latch member in a direction toward its engaged position, and a shoulder portion near leaf spring end for limiting movement of said first latch member relative thereto and defining the second position of said first latch member, said curved portion being prestressed to bias said first latch member against said tab member;

a stop member connected with said first element for engagement by said first latch member for limiting the movement thereof in a direction opposite the latching direction and defining the first position of said first latch member; and guide means for causing movement of and guiding said first latch member toward said second position during movement of said first latch member toward its disengaged position, said guide means including a beveled surface adapted for engagement by said nose portion for guiding and causing movement of said first latch member toward said second position during movement of said first latch member toward its disengaged position.

16. A latch assembly for preventing movement in a latching direction of a first element relative to a second element comprising:

a first latch member connected with said first element and adapted for latching engagement with a second latch member of said second element, said first latch member adapted for limited movement relative to said first element in a direction generally parallel to the latching direction between first and second positions and for limited movement in a direction generally perpendicular to the latching direction between an engaged position in which said first and second latch members are engaged and a disengaged position in which said first and second latch members are disengaged;

means for manually disengaging said first and second latch members;

bias means including a leaf spring for biasing said first latch member toward its engaged position said first latch member including a slot into which one end of said leaf spring extends to facilitate limited sliding movement between said first latch member and said leaf spring;

a stop member connected with said first element for engagement by said first latch member for limiting the movement thereof in a direction opposite the latching direction and defining the first position of said first latch member; and guide means for causing movement of and guiding said first latch member toward said second position during movement of said first latch member toward its disengaged position.

* * * * *